US006446271B1

(12) United States Patent
Ho

(10) Patent No.: US 6,446,271 B1
(45) Date of Patent: Sep. 10, 2002

(54) AUXILIARY BUFFER ENVELOPE DEVICE FOR INNER PAD OF SAFETY HELMET

(76) Inventor: Chang-Hsien Ho, 10F, No. 27, Lane 40, Yu-Ming 1st Rd., Pei-Tou Dist., Taipei (TW)

( * ) Notice: Subject to any disclaimer, the term of this patent is extended or adjusted under 35 U.S.C. 154(b) by 0 days.

(21) Appl. No.: 09/867,407

(22) Filed: May 31, 2001

(51) Int. Cl.[7] ..... A42B 3/00
(52) U.S. Cl. ..... 2/414; 2/417; 2/425
(58) Field of Search ..... 2/414, 411, 412, 2/413, 417, 418, 425, 415

(56) References Cited

U.S. PATENT DOCUMENTS

| | | | | | |
|---|---|---|---|---|---|
| 3,292,180 | A | * | 12/1966 | Marietta | 2/415 |
| 3,447,162 | A | * | 6/1969 | Aileo | 2/209 |
| 3,577,562 | A | * | 5/1971 | Holt | 2/414 |
| 3,609,763 | A | * | 10/1971 | Raney | 2/415 |
| 3,628,190 | A | * | 12/1971 | Molitoris | 2/418 |
| 3,720,955 | A | * | 3/1973 | Rawlings | 2/415 |
| 3,873,997 | A | * | 4/1975 | Gooding | 2/413 |
| 3,943,572 | A | * | 3/1976 | Aileo | 2/209 |
| 3,946,441 | A | * | 3/1976 | Johnson | 2/412 |
| 4,566,137 | A | * | 1/1986 | Gooding | 2/413 |
| 5,083,320 | A | * | 1/1992 | Halstead | 2/413 |
| 5,930,840 | A | * | 8/1999 | Arai | 2/411 |
| 6,178,560 | B1 | * | 1/2001 | Halstead et al. | 2/413 |
| 6,226,801 | B1 | * | 5/2001 | Alexander et al. | 2/413 |
| 6,256,797 | B1 | * | 7/2001 | Nemoto et al. | 2/414 |

FOREIGN PATENT DOCUMENTS

| | | | |
|---|---|---|---|
| EP | 108694 | * | 5/1984 |
| EP | 423711 | * | 4/1991 |

* cited by examiner

*Primary Examiner*—Rodney M. Lindsey
(74) *Attorney, Agent, or Firm*—Troxell Law Office PLLC

(57) ABSTRACT

Auxiliary buffer envelope device for inner pad of safety helmet, including at least one attachable buffer envelope disposed on a section of the inner pad near the rear bottom edge thereof. The buffer envelope is filled in the gap between the rear side of the inner pad and the curve of the rear lower dented part of a user's skull. The buffer envelope enables a user to more snugly wear the helmet with better fixing and shakeproof effect. The buffer envelope reversely retain rear dented part of, the user's skull so as to more reliably prevent the helmet from detaching from the skull and provide a fixing and protective effect for the head of the user. The buffer envelope has simple structure and can be easily connected with the helmet.

7 Claims, 6 Drawing Sheets

AUXILIARY BUFFER ENVELOPE DEVICE FOR INNER PAD OF SAFETY HELMET

BACKGROUND OF THE INVENTION

The present invention is related to an auxiliary buffer envelope device for inner pad of, safety helmet, including at least one attachable buffer envelope disposed on a section of the inner pad near the rear bottom edge thereof. The buffer envelope being filled in the gap between the rear side of the inner pad and the curve of the rear lower dented part of a user's skull. The buffer envelope enables a user to fully: snugly wear the helmet and provides a retaining effect for the skull. Therefore, the user can stably wear the helmet with better protective effect.

FIG. 1 shows a conventional safety helmet having an outer casing 10 and an inner cushion pad 20. Due to the need of demolding of the product, the inner diameter of the bottommost periphery of the open side of the outer casing 10 and the inner pad 20 is larger than the inner diameter of any other portions. Accordingly, the bottom peripheries 11, 21 of the outer casing 10 and the inner pad 20 have a gradually diverging curvature. Such curvature is reverse to the gradually converging curvature 31 of the lower half part of a human skull 30. Therefore, when wearing the helmet on the skull 30, a gradually enlarged gap 32 exists between the inner periphery of the bottom of the inner pad 20 and the skull 30. This leads to shortcomings as follows:

1. It is hard to firmly wear the helmet on the head. During movement of a user, the helmet tends to shake on the head.

This makes it uncomfortable to wear the helmet and affects safety.

2. The helmet itself lacks any holding effect for the skull and the helmet is fixed on the head entirely by means of the fastening straps. In the case of over-pulling of the fastening straps, the skull will be over-compressed by the helmet and feel uncomfortable and even get hurt.

3. The back lower part of the skull is the weakest part of the head. However, the gap of the conventional helmet can hardly provide any protective effect for this part. This makes the helmet lose its function.

4. In the case that the helmet is processed to solve the above problem, the processing procedure and the mold will be complicated and the production efficiency will be lowered and the manufacturing cost will be increased.

SUMMARY OF THE INVENTION

It is therefore a primary object of the present invention to provide an auxiliary buffer envelope device for inner pad of safety helmet, which is filled in the gap between the rear side of the inner pad and the curve of the rear lower dented part of a user's skull. The buffer envelope enables a user to more snugly wear the helmet with better fixing and shakeproof effect.

It is a further object of the present invention to provide the above buffer envelope device which provides a retaining effect for the skull and prevents the helmet from easily detaching from the skull. Therefore, the helmet is not fixed on the user's head totally by means of the fastening straps' and the user can more comfortably wear the helmet.

The present invention can be best understood through the following description and accompanying drawings wherein:

DETAILED DESCRIPTION OF THE PREFERRED EMBODIMENTS

Figure 1:
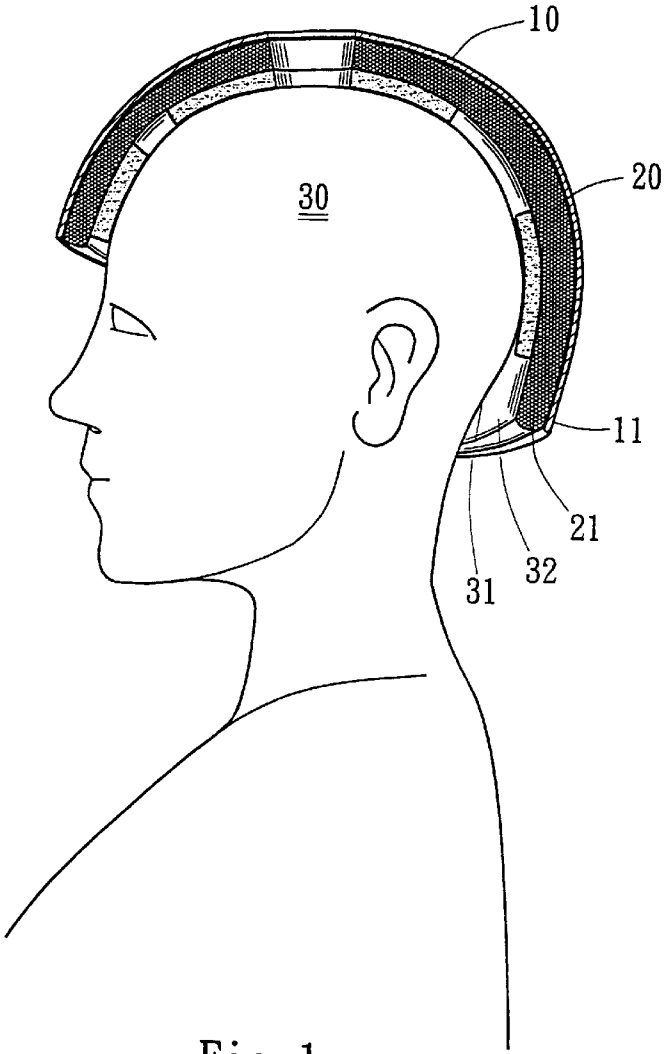
Fig. 1 PRIOR ART
FIG. 1 is a sectional view of a conventional safety helmet worn on a user's head.
Figure 2:
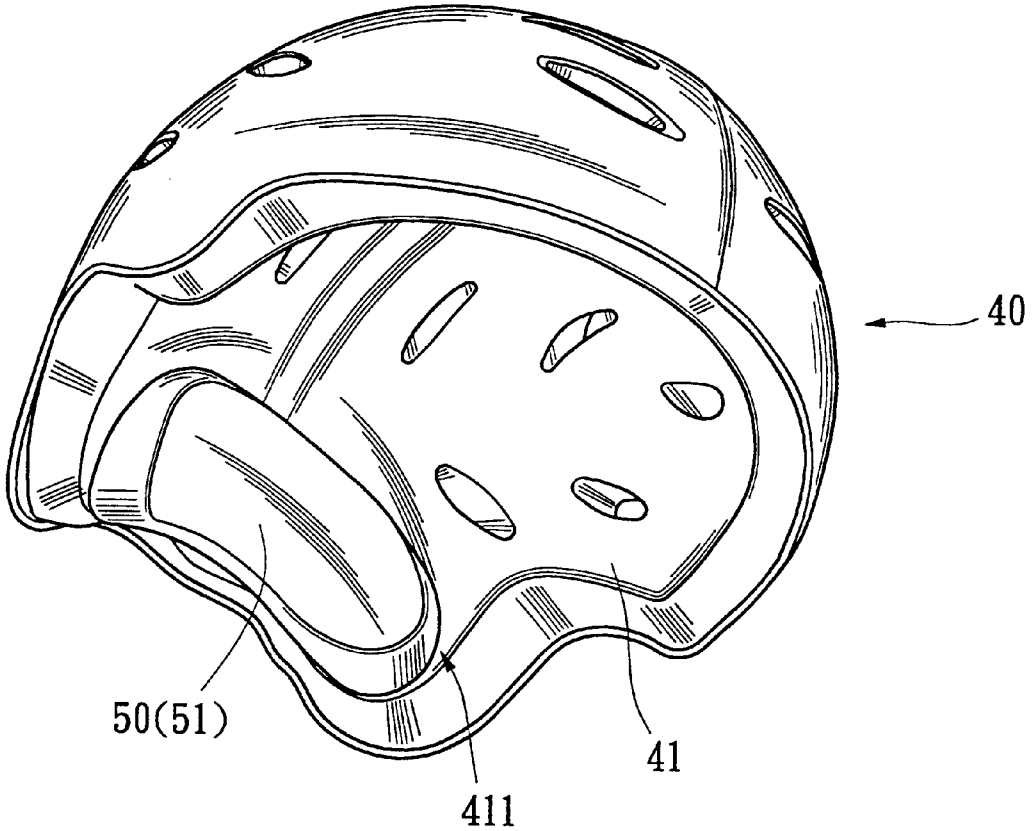
FIG. 2 is a perspective view of a preferred embodiment of the present invention.
Figure 3:
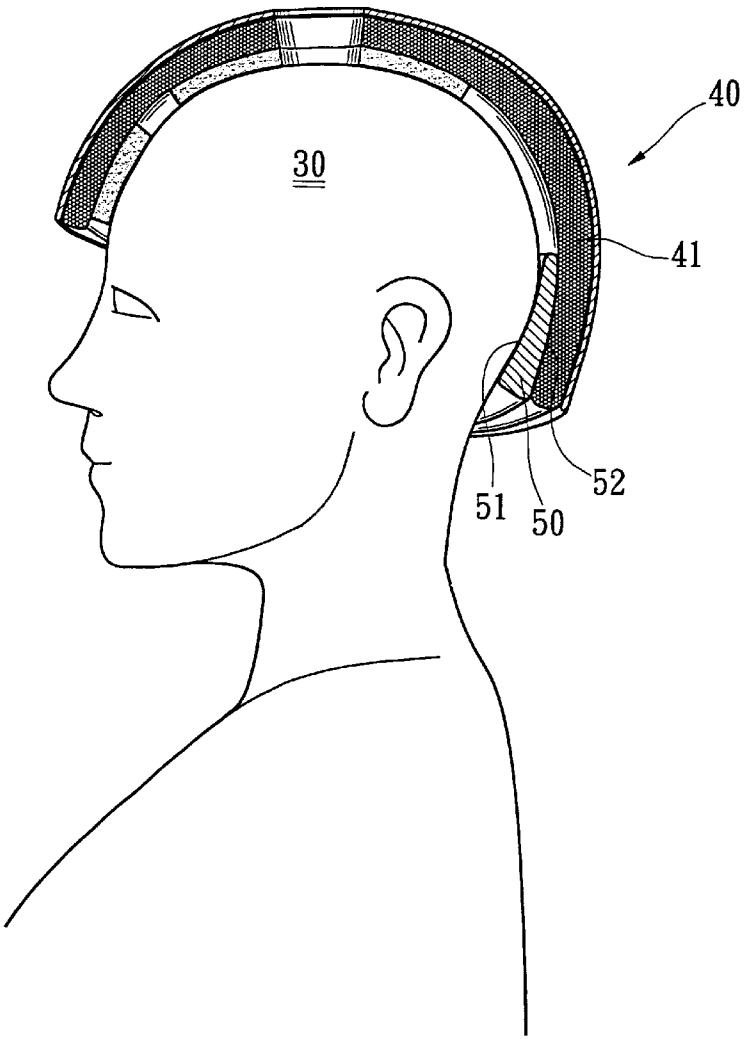
FIG. 3 is a sectional view of the safety helmet of FIG. 2 in a wearing state.

Please refer to FIGS. 2 and 3. The present invention includes a buffer envelope 50 additionally disposed on a section 411 near the rear edge of the inner pad 41 of the helmet 40. The buffer envelope 50 has an inner arched face 51 in accordance with the curvature of rear side of the skull 30 and an outer arched face 52 attachable to inner arched face of the section 411 of the inner pad 41. In accordance with the curvatures of the rear lower sections if the inner pad 41 and the skull 30, the buffer envelope 50 substantially has thinner upper end and center and is gradually thickened toward the lower end and two lateral sides. Therefore, the helmet can more snugly and completely encloses and covers the skull. The thickened portion of the buffer envelope can reversely retain lower side of the rear dented portion of the skull 30 and naturally provide a holding force for the skull 30 without loosening or detachment so as to ensure safety. Furthermore, by means of the buffer envelope, the curvature of the inner face of the helmet fully accords with the curvature of the skull. Therefore, during movement, the shake and unstability of the helmet worn on the head can be effectively minimized and a user can more comfortably wear the helmet.

Figure 4:
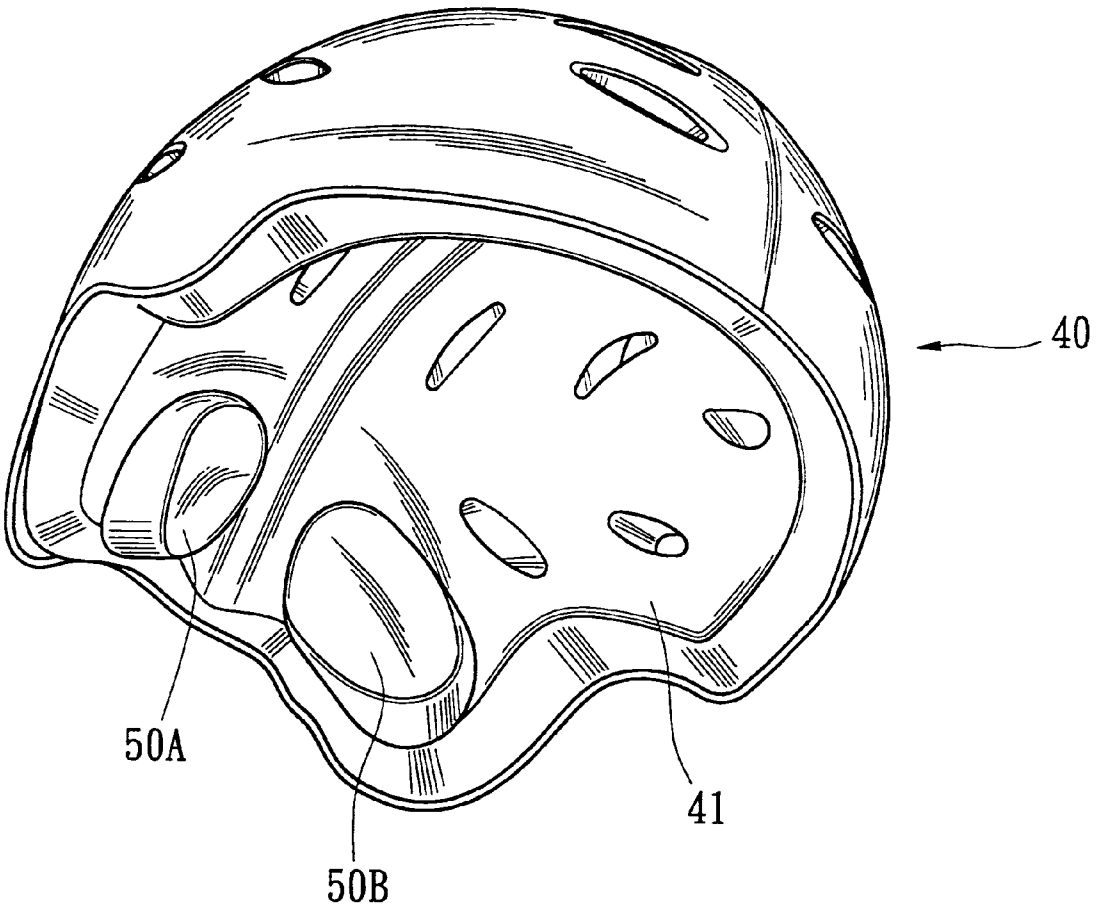
FIG. 4 is a perspective view of a second preferred embodiment of the present invention.
Figure 5:
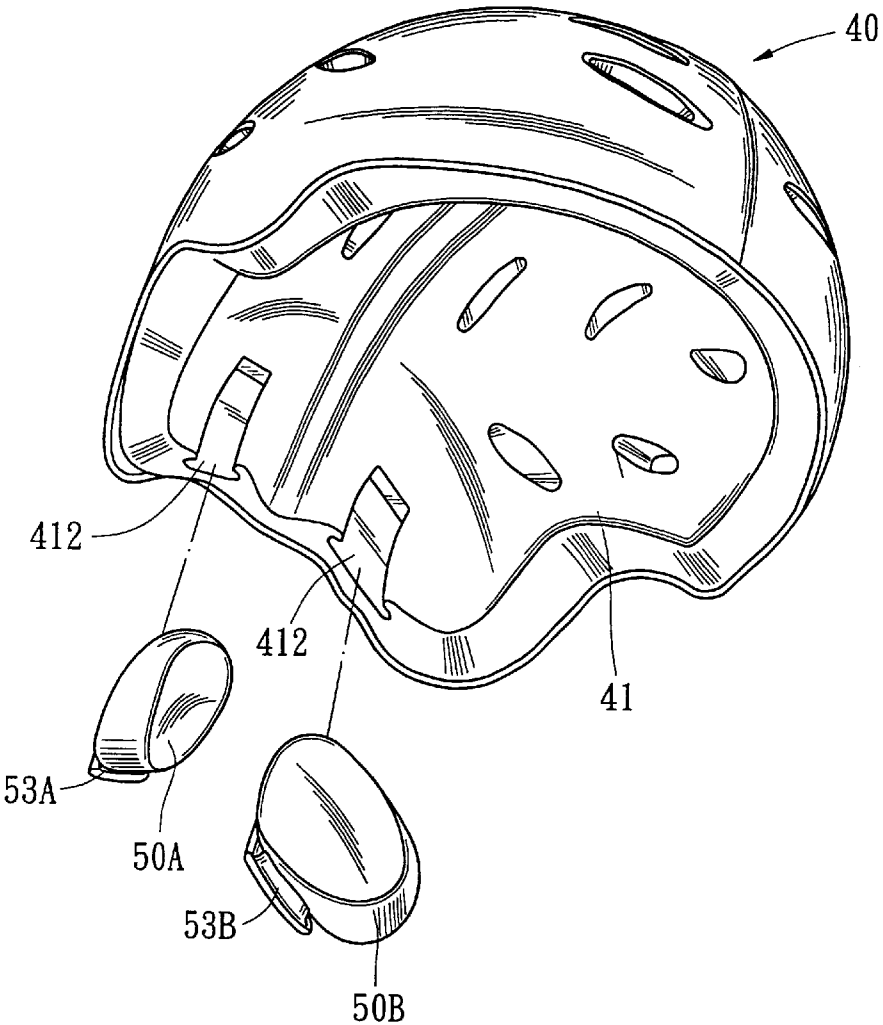
FIG. 5 is a perspective exploded view of a third preferred embodiment of the present invention.
Figure 6:
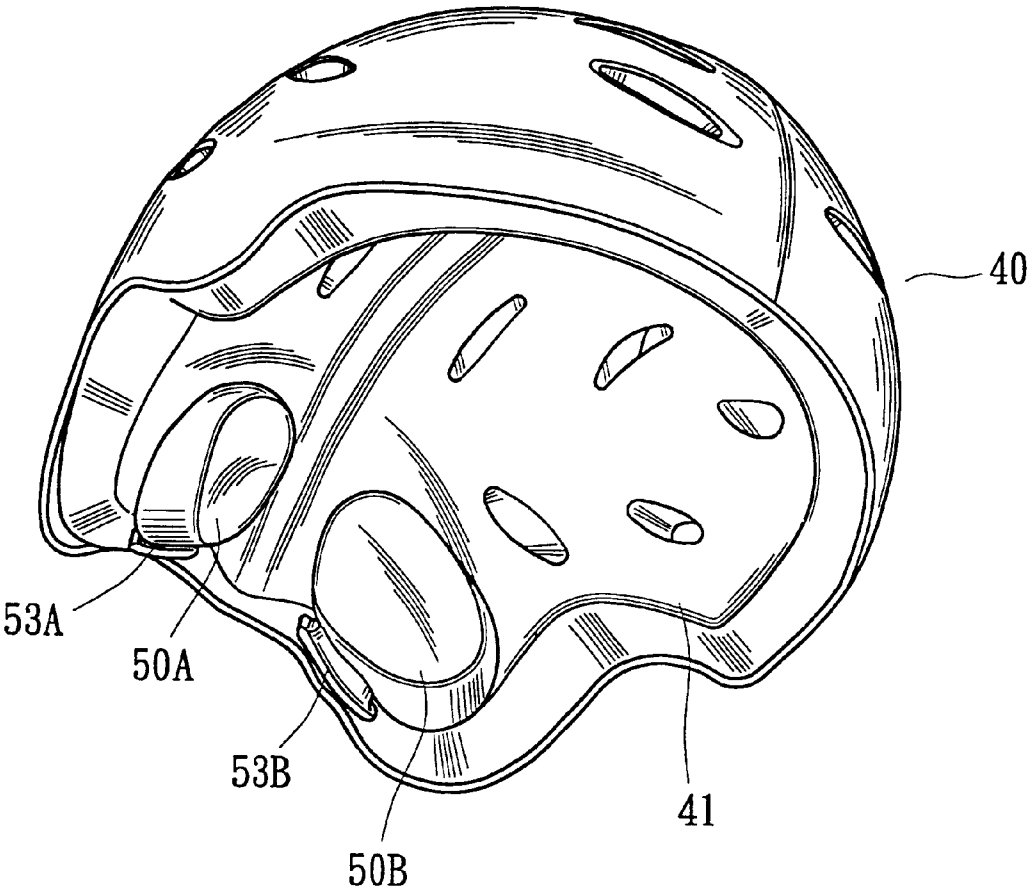
FIG. 6 is a perspective assembled view of the third preferred embodiment of the present invention.

Referring to FIG. 4, alternatively, the buffer envelope 50 can have at least two divisional blocks 50A, 50B respectively directly attaching to two rear sections of the inner pad 41. Alternatively, as shown in FIGS. 5 and 6, the back faces of the divisional blocks 50A, 50B can be integrally formed with insertion seats 53A, 53B. The rear sections of the inner pad 41 are provided with corresponding insertion slots 412 in which the insertion seats 53A, 53B are directly inserted. When wearing the helmet on the head, the insertion seats 53A, 53B are more firmly located in the insertion slots 412 without loosening.

The buffer envelope 50 can be a close-type envelope containing therein various kinds of fluids (including air or various thick fluids or mixtures of fluids) in accordance with the needs of various situations.

The above embodiments are only used to illustrate the present invention, not intended to limit the scope thereof. Many modifications of the above embodiments can be made without departing from the spirit of the present invention.

What is claimed is:

1. An auxiliary buffer device for a safety helmet having an inner pad on an interior of the helmet, the auxiliary buffer device comprising at least one buffer envelope having an outer convexly arched face in contact with a rear inner section of the inner pad and an inner concavely arched face configured to match a curvature of a rear side of a skull of a user, the at least one buffer envelope having an upper end and a lower end wherein the lower end has a thickness greater than a thickness of the upper end, and also having a portion adjacent to a center of the helmet and at least one lateral side wherein the at least one lateral side has a thickness greater than a thickness of the portion adjacent to the center of the helmet.

2. The auxiliary buffer device of claim 1 wherein the at least one buffer pad has two lateral sides wherein thicknesses of the two lateral sides are greater than the thickness of the portion adjacent to the center of the helmet.

3. The auxiliary buffer device of claim 2 wherein the at least one buffer pad comprises a single buffer pad.

4. The auxiliary buffer device of claim 1 wherein the at least one buffer envelope comprises a plurality of separate, spaced apart divisional blocks.

5. The auxiliary buffer device of claim 4 further comprising:

a) a plurality of insertion slots formed in rear sections of the inner pad; and, b) an insertion seat on each of the plurality of divisional blocks and engaging one of the plurality of insertion slots.

6. The auxiliary buffer device of claim 4 comprising two divisional blocks.

7. The auxiliary buffer device of claim 1 wherein the at least one buffer envelope comprises a closed envelope containing a fluid.

* * * * *